US008378576B2

(12) United States Patent
Abarra et al.

(10) Patent No.: US 8,378,576 B2
(45) Date of Patent: Feb. 19, 2013

(54) ION BEAM GENERATOR

(75) Inventors: Einstein Noel Abarra, Hachioji (JP); Yasushi Miura, Kawasaki (JP); Eiji Fujiyama, Chigasaki (JP); Naoyuki Suzuki, Tama (JP); Yasuyuki Taneda, Hachioji (JP); Yasushi Kamiya, Fuchu (JP)

(73) Assignee: Canon Anelva Corporation, Kawasaki-shi (JP)

( * ) Notice: Subject to any disclaimer, the term of this patent is extended or adjusted under 35 U.S.C. 154(b) by 214 days.

(21) Appl. No.: 12/897,400

(22) Filed: Oct. 4, 2010

(65) Prior Publication Data

US 2011/0139998 A1 Jun. 16, 2011

(30) Foreign Application Priority Data

Dec. 15, 2009 (JP) ..... 2009-284129

(51) Int. Cl.
*H05B 31/26* (2006.01)

(52) U.S. Cl. ..... 315/111.21; 315/111.31; 315/111.91

(58) Field of Classification Search ..... 315/111.21, 315/111.31, 111.61, 111.81; 250/424, 423 R, 250/396 R See application file for complete search history.

(56) References Cited

U.S. PATENT DOCUMENTS

| | | | | |
|---|---|---|---|---|
| 3,970,892 | A * | 7/1976 | Wakalopulos | 315/111.31 |
| 6,975,073 | B2 * | 12/2005 | Wakalopulos | 315/111.81 |
| 7,166,965 | B2 * | 1/2007 | Ito et al. | 315/111.91 |
| 7,223,990 | B2 * | 5/2007 | Lee et al. | 250/492.21 |
| 2003/0184235 | A1 * | 10/2003 | Nakamura | 315/111.21 |
| 2004/0195972 | A1 * | 10/2004 | Cornelius | 315/111.21 |
| 2008/0156998 | A1 * | 7/2008 | Sugiyama | 250/396 R |

FOREIGN PATENT DOCUMENTS

| | | |
|---|---|---|
| JP | 2005-506656 | 3/2005 |
| WO | WO 02/097850 | 12/2002 |

* cited by examiner

*Primary Examiner* — Tung X Le

(74) *Attorney, Agent, or Firm* — Fitzpatrick, Cella, Harper & Scinto

(57) ABSTRACT

[Objection of the invention]An ion beam generator, a thermal distortion in a grid assembly is reduced. [Structure to solve the objection]Thermal expansion coefficients $\alpha_P$, $\alpha_M$ and $\alpha_G$, for a sidewall (1A) of a discharge chamber, mounting platform (40) and extraction grid electrode assembly (20) are selected to have a relation: $\alpha_P > \alpha_M \geqq \alpha_G$. For example, the material of discharge chamber sidewall is stainless steel o aluminum, the material of grids is Mo, W or C and the material of platform is Ti or Mo.

10 Claims, 9 Drawing Sheets

ION BEAM GENERATOR

CROSS-REFERENCES TO RELATED APPLICATIONS

This application claims the benefit of priority from Japanese Patent Application No. 2009-284129 filed Dec. 15, 2009, the entire contents of which is incorporated herein by reference.

TECHNICAL FIELD

The present invention relates to an ion beam generator, particularly a structure for reducing thermal distortion in grids.

BACKGROUND ARTS

One conventional ion beam generator is disclosed in patent publication 2005-506656A. When the ion beam generator is used in a sputtering or etching system, an appropriate gas such as argon is introduced into a discharge chamber through gas introducing means. A plasma is generated by applying a rf power to the gas. Normally, the generated plasma is confined within the discharge chamber. Part of the plasma is in the vicinity of ion beam extraction units in respective facets. An assembly of grids which extract ions from the discharge chamber thereinto and accelerate ions therethrough are provided in each of the ion beam extraction units.

PRIOR ART REFERENCES

Patent References

Patent Reference 1: Patent Publication 2005-506656A: PCT/GB2002/002544

In such conventional ion beam generator, there is a technical problem that, during operation, the beam extraction unit is thermally expanded so that grids of the unit are distorted. Consequently, beam extraction efficiency deteriorates and thus the etching or sputtering performance is degraded. Accordingly, the objective of the invention is to prevent (reduce) the thermal distortion in the extraction unit for the purpose of providing the ion beam generator with an improved process quality.

SUMMARY OF THE INVENTION

According to the present invention, there is provided an ion beam generator comprising a plasma discharge chamber; an extraction electrode assembly, which extracts ions in the plasma generated in the plasma discharge chamber and generates an ion beam; a mounting platform disposed between the plasma discharge chamber and the extraction electrode assembly for mounting the extraction electrode assembly onto the plasma discharge chamber, wherein at least part of the sidewall of the plasma discharge chamber which contacts the mounting platform has thermal expansion coefficient TEC=$\alpha_P$, the mounting platform has thermal expansion coefficient TEC=$\alpha_M$ and the extraction electrode assembly has thermal expansion coefficient TEC=$\alpha_G$ where the $\alpha_P$, $\alpha_M$, $\alpha_G$ satisfy the formula: $\alpha_P > \alpha_M \geqq \alpha_G$.

In the embodiment, the extraction electrode assembly comprises a screen grid, accelerator grid and decelerator grid. The sidewall of the plasma discharge chamber is made of stainless steel or aluminum. The mounting platform is made of Ti or Mo. The grids are made of Mo, W or C. The thickness of each grid is equal to or larger than 2 mm. The screen grid has apertures through which the ion beam passes, each aperture having a first and second straightly bored holes with different diameters joined by tapered hole, wherein the larger diameter hole is on the side facing the accelerator grid.

According to another aspect of the present invention, there is provided an ion beam generator comprising a plasma discharge chamber, a ring-like mounting platform attached to an annular sidewall of the plasma discharge chamber and comprising a first ring member and second ring member, a disc-like extraction electrode assembly mounted between the first and second ring members of the mounting platform and a bolt surrounded by an insulator, wherein each of the first, the second ring members of the mounting platform and the extraction electrode assembly has the bolt apertures at the edge peripheral region thereof through which the bolt surrounded by the insulator penetrates and the penetrated bolts fix the extract electrode assembly between the first and second ring members, and wherein the inner surfaces of the bolt apertures in the extraction electrode assembly tightly contact with the outer surface of the insulator surrounding the bolt and the bolt aperture in the first and second ring members are elongated in a radical direction so that there is a spacing between the inner surfaces of the bolts apertures in the first and second ring members and the outer surface of the insulator surrounding the bolt. In this aspect, the above thermal expansion coefficients have the relation represented by the formula: $\alpha_P > \alpha_M \geqq \alpha_G$.

In the ion beam generator of the invention, distortions in the grids are suppressed so that a high quality ion beam is produced.

DETAILED DESCRIPTION OF THE EMBODIMENTS

Hereinafter, embodiments of the present invention will be described with reference to the drawings. However, the present invention will not be limited to the present embodiments.

Figure 1:
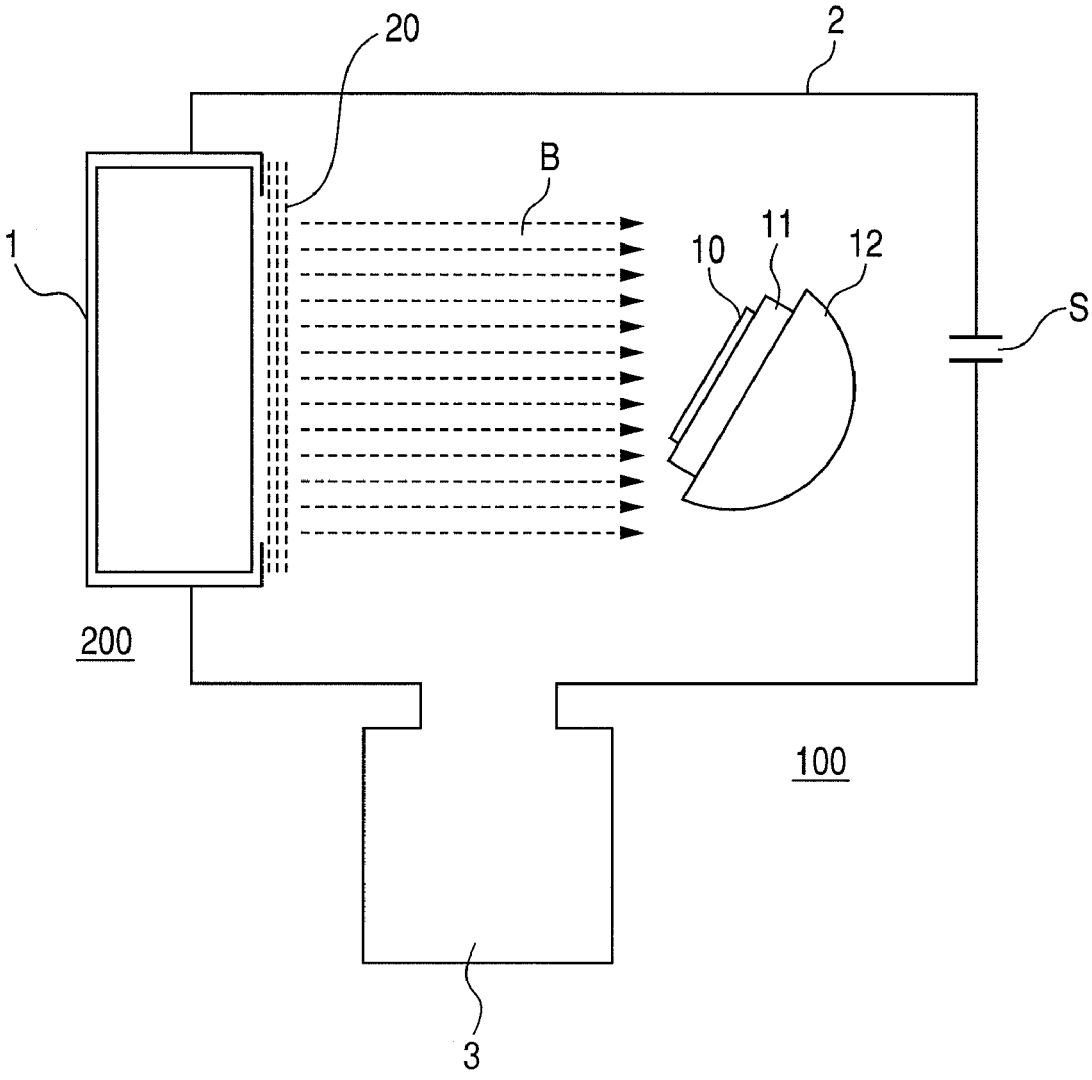
FIG. 1 is a schematic view of substrate processing apparatus which includes an ion beam generator according to the present invention.

A substrate processing apparatus, such as etching apparatus, according to an embodiment of the present invention will be described with reference to FIG. 1. FIG. 1 illustrates the configuration of the substrate etching apparatus. A substrate processing apparatus 100 as illustrated in FIG. 1 comprises a substrate processing chamber 2, holder 11 configured to hold a substrate (wafer) 10, rotatable stage 12 which supports the substrate holder 11, ion beam generator 200 for generating an ion beam, and a vacuum pump 3 for evacuating an atmosphere inside the chamber 2. In ion beam generator 200, extraction electrode assembly 20 for extracting ions in the plasma is disposed on the front surface of plasma discharge chamber 1. The substrate holder 11 is configured so as to be inclined at a selected angle to the traveling direction of ion beam B. The angle of the wafer surface relative to the incident ion beam can be changed by panning cathode 12. The substrates are transported into and out of the ion beam etching chamber through slit S.

Figure 2:
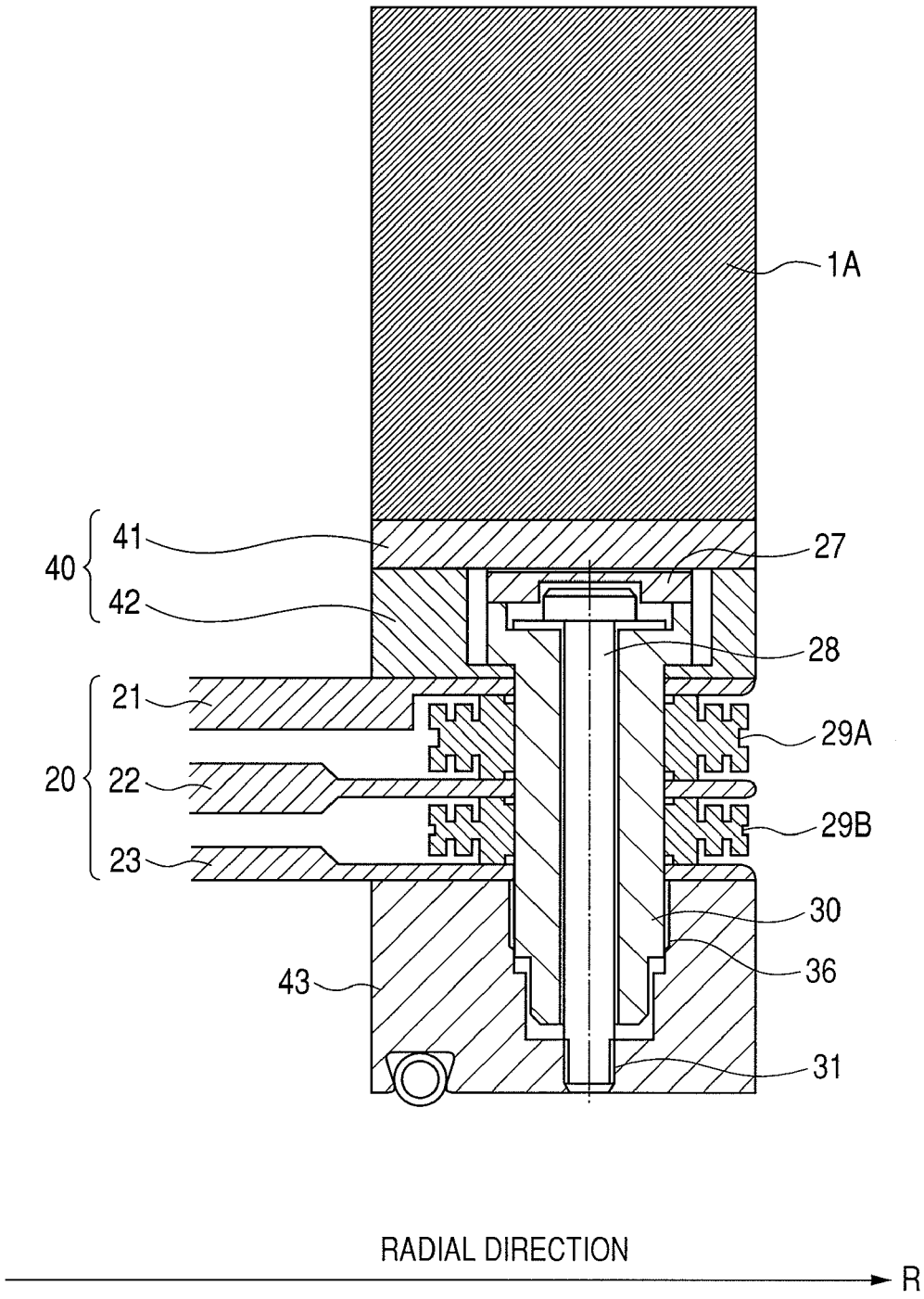
FIG. 2 is a cross-sectional view of a first embodiment of ion beam generator according to the present embodiment.
Figure 4:
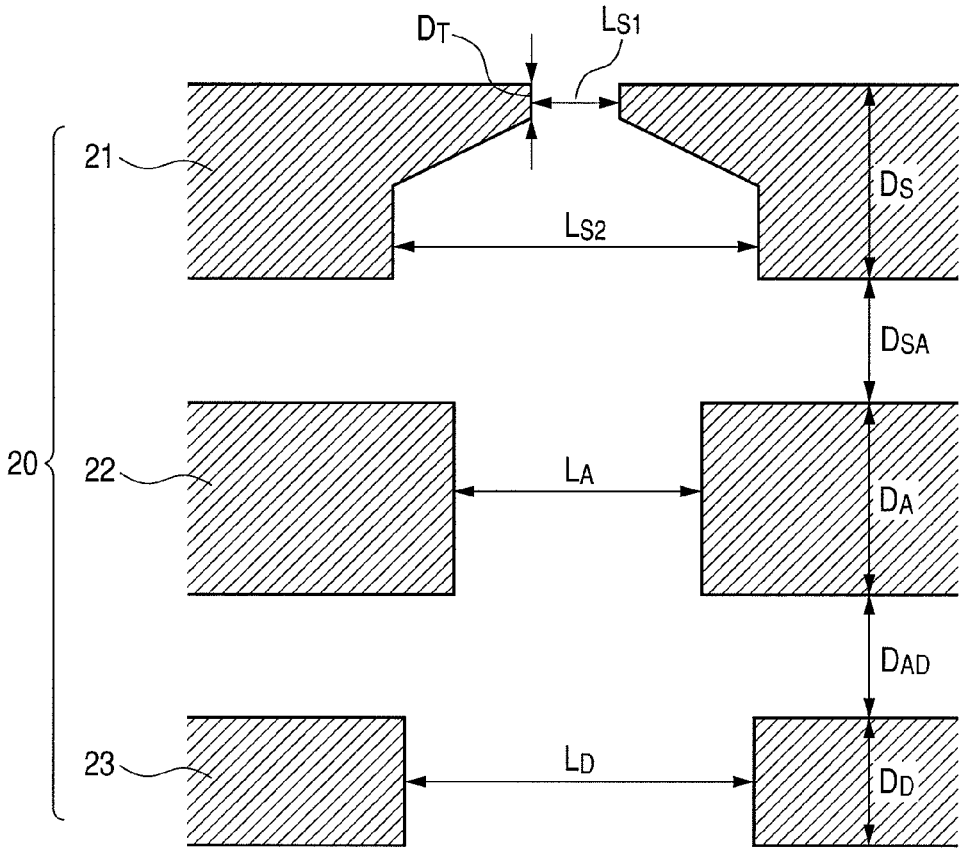
FIG. 4 is a cross sectional view of a grid assembly in an ion beam generator according to the present invention.

FIG. 2 is a cross-sectional view of the grid mount part in a first embodiment of ion beam generator 200. As shown in FIG. 4, the extraction electrode assembly 20 comprises of three disc-like grids 21, 22 and 23 apertures of which are aligned to one another. The extraction electrode assembly 20 is mounted on an annular sidewall 1A of the plasma discharge chamber 1 via annular or ring-like mounting platform 40. The mounting platform 40 for mounting the annular peripheral regions of the disc-like grids 21-23 onto the plasma discharge chamber 1 comprises cap ring 41 and first ring 42 and second ring 43. The cap ring 41 is attached to the sidewall 1A of the chamber 2. The first ring 42 is in contact with the cap ring 41. The lower surface of the first ring 42 is in contact with the screen grid 21. The grids 21, 22 and 23 are disposed between the first ring 42 and the second ring 43 that are bolted together by sandwiching the assembly 20 between the rings 42 and 43.

The metal fixing bolt 28 is screwed into the second ring 43 to fixedly mount the extraction electrode assembly 20 onto the mounting platform-first ring 42. The metal fixing bolt 28 is insulated from the screen grid 21, accelerator grid 22, and decelerator grid 23 by the cylindrical alignment insulator 30. The metal fixing bolt 28 is further isolated from cap ring 41 by an insulating bolt cap 27. While the top of the fixing bolt 28 is capped with the cap ring 41, the insulating bolt cap 27 is held in place by the cap ring 41. The cylindrical insulator 30 serves as an alignment fixture for the grid apertures of the grids 21, 22 and 23. The inner surface of the aperture 36 in each of grids 21, 22 and 23 tightly contact with the outer surface of the insulator 30. The grids 21, 22 and 23 are rigidly fixed to the cylindrical insulator 30. Namely, the fixing bolt 28 is covered by the cylindrical alignment insulator 30 which is inserted into apertures or bolt holes of the first and second rings 42 and 43 and extraction electrode assembly 20 so that all the grids of the extraction electrode assembly 20 are exactly aligned in their positioning. The upper surface of the second ring 43 is in contact with the decelerator grid 23.

A spacer insulator 29A is disposed between the screen grid 21 and the accelerator grid 22. A spacer insulator 29B is disposed between the accelerator grid 22 and the decelerator grid 23. Depending on size, an electrode assembly may have more than 20 bolt apertures uniformly distributed around the electrode edge with the accompanying cylindrical insulators, spacers, and insulating caps. For mounting the extraction electrode assembly 20 to sidewall 1A of the plasma chamber 1, another means may be provided in the mounting platform 40. For example, through holes or openings may be provided between the above-mentioned holes for bolting the first ring 42 to the sidewall 1A of the chamber 1. The screen grid 21 may also be bolted together with the first ring 42 and cap ring 41 to the sidewall 1A of the chamber 1. The grids 21, 22 and 23 are electrically isolated from the sidewall 1A of the plasma discharge chamber 1.

In the embodiment illustrated in FIGS. 1 and 2, common materials being employed are aluminum (Al) or SUS for the sidewall 1A of the chamber 1. Dielectric materials such as alumina or quartz are typically utilized for some parts of the plasma chamber 1 in the case inductively-coupled sources to allow external magnetic or electric fields into the chamber. The dielectric material is usually held in place and supported by rigid materials such as SUS or Al. Moreover, the portion where the mounting platform 40 is mounted must be strong and rigid and is also made of either Al or SUS. The plasma discharge chamber 2 may be cooled by forced air or water. The grids 21, 22 and 23 are typically made of Mo or C due to their low thermal expansion coefficients and strength at high temperatures. The emphasis on mounting platforms has been on rigidity. The mounting holes on Mo grids may also be elongated along the (thermal) expansion direction but the alignment of the grids to each other is critical and must not be compromised.

The sidewall 1A of the discharge chamber 1 warms when plasma is ignited in the discharge chamber 1. The electrode grids 21, 22 and 23 are also heated up and since they have less thermal mass than the discharge chamber 1, the grids 21, 22 and 23 tend to significantly heat up. Furthermore, for high accelerator voltages, the accelerator grid 22 may attract ions with enough energy to sputter the material. The high energy ions further contribute to heating. Cooling is performed by radiation and conduction to the grid edge which is usually in contact with the mounting platform and the discharge chamber walls. The high temperatures and temperature gradients result in grid deformation or grid aperture misalignment that influence etching uniformity, stability, and grid conditioning time.

For a specific embodiment, during the operation of the ion beam generator 200 comprising the plasma discharge chamber 1 and extraction electrode assembly 20, the temperature of sidewall 1A of the plasma discharge chamber 1 rises to approximately 75° C. and the temperature of grids 21, 22 and 23 rise to approximately 200° C. Here, the average temperature of the grids given as the grid temperature is not uniform, namely it is hottest in the center and coolest at the edge. To fasten and mount grids 21, 22 and 23, a mounting platform 40 is disposed between the plasma discharge chamber 1 and the extraction electrode assembly 20. To reduce thermal distortion upon operation, the thermal expansion coefficients among them should be selected to satisfy the following relation, $$\alpha_P > \alpha_M \geqq \alpha_G,$$

where the thermal expansion coefficient of sidewall 1A of plasma discharge chamber 1 which contacts the mounting platform 40 is $\alpha_P$, the thermal expansion coefficient of mounting platform 40 is $\alpha_M$, and the thermal expansion coefficient of the extraction electrode assembly 20 is $\alpha_G$.

As embodiments, the material of the sidewall 1A is selected from the group of stainless steel (SUS) and aluminum. The material of the mounting platform 40 is selected from the group of Ti and Mo. The materials of the grids 21, 22 and 23 are selected from the group of Mo, W and C. The thermal expansion coefficient of Mo used for the grids is $5\times10^{-6}$ $K^{-1}$, the expansion coefficient of Ti used for the mounting platform 40 is $8.7\times10^{-6}$ $K^{-1}$ and the thermal expansion coefficient of Al used for the sidewall 1A is $23\times10^{-6}$ $K^{-1}$. The above combination of materials satisfy the relation ($\alpha_P > \alpha_M \geqq \alpha_G$).

In this section, a plasma discharge sidewall 1A made of Al and a circular beam extraction electrode assembly 20 comprising of Mo grids of diameter=400 mm are considered as an example. Comparison will be made between the effect of a stainless steel (SUS) mounting platform and a Ti mounting platform especially on the screen grid thermal distortion. Eight bolt apertures 36 uniformly distributed near the edge are provided for bolts to fasten the screen grid 21 and mounting platform 40 to plasma discharge chamber sidewall 1A. The apertures are disposed apart from each other by 149 mm. During operation of the ion beam generator, the temperature of the sidewall 1A of the plasma discharge chamber 1 rises to about 75° C. from room temperature, the mounting platform temperature rises to about 140° C., and the average grid temperature rises to about 200° C. Along the radial direction R in FIG. 2 and FIG. 5, the Mo grid aperture locations shift due to radical direction thermal expansion of the grid by $\Delta R=0.16$ mm. Along the circumference, the distance between the grid apertures expands by $\Delta C=0.13$ mm. The Al sidewall 1A-apeture positions shift radially by $\Delta R=0.20$ mm and the aperture distances expand by $\Delta C=0.15$ mm. For a SUS mounting platform 40 ($\alpha=15\times10^{-6}$ $K^{-1}$), $\Delta R=0.31$ mm and $\Delta C$ is 0.25 mm. While, for a Ti mounting platform ($\alpha=5\times10^{-6}$ $K^{-1}$), $\Delta R=0.18$ mm and $\Delta C$ is 0.14 mm. These values are very close in the values for the Al chamber sidewall 1A, Ti platform 40 and Mo screen grid. A 0.1 mm shift in the relative aperture positions for the screen grid, the mounting platform, and the sidewall is small, as compared to the overall beam extraction electrode diameter, and sufficient to improve start-up performance.

Figure 3:
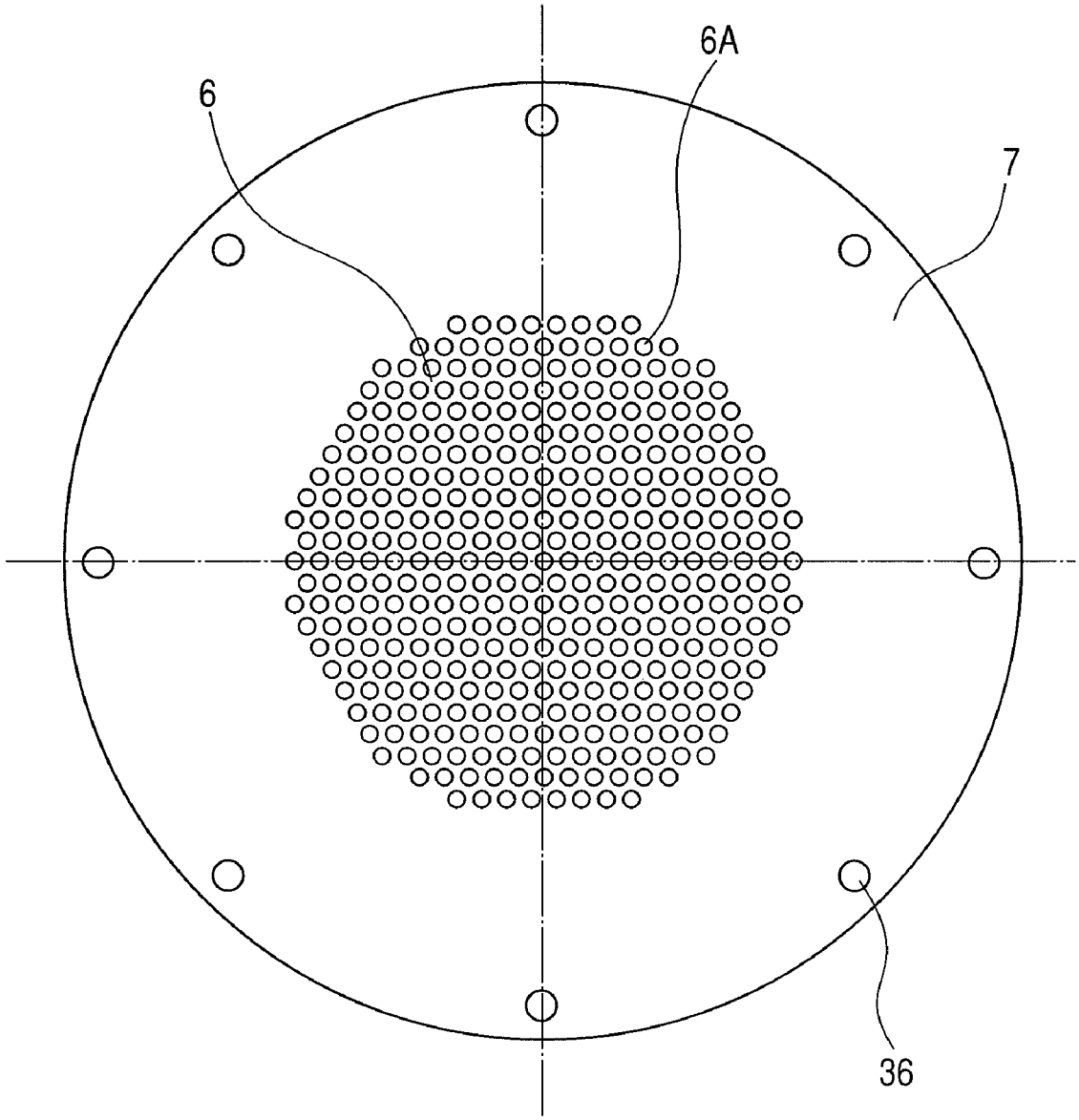
FIG. 3 is a plane view of a grid in an ion beam generator according to the present invention.

FIG. 3 shows an embodiment of grids in an ion beam generator according to the present invention. Each of grids 21, 22 and 23 comprises a central aperture region 6 and outer region 7 surrounding the central aperture region 6. The central aperture region 6 has many small ion beam apertures 6A. The ion beam extracted from the plasma discharge chamber 1 passes through ion beam apertures 6A in the central aperture region 6. The outer region 7 may have eight (or more) bolt apertures 36 configured to insert eight (or more) bolts 28 each of which is enveloped by a cylindrical alignment insulator 30.

FIG. 4 shows a sectional view of the extraction electrode assembly 20 in an ion beam generator according to the present invention. By inserting the bolt 28 into the bolt aperture 36 of each grids, as shown in FIG. 4, the apertures 6A in the central aperture region 6 of screen grid 21, the apertures 6A in the central aperture region 6 of accelerator grid 22, and the ion beam apertures 6A in the central aperture region 6 of the decelerator grid 23 are spatially-ordered or aligned. In this embodiment, the thickness DS of screen grid 21 is 3 mm, the thickness DA of accelerator grid 22 is 3 mm, the thickness DD of decelerator grid 23 is 2 mm. The spacing DSA between screen grid 21 and accelerator grid 22 is 2 mm, the spacing DAD between accelerator grid 22 and decelerator grid 23 is 2 mm. Grids can be made thicker to reduce warping. This is especially useful when bolting in the ion beam aperture area is not desired. For thicker grids (>2 mm), the screen grid is preferably tapered. The increased thickness raises the accelerator voltage V2 requirements to >1000V to achieve good beam collimation.

In the screen grid 23, each ion beam aperture has a diameter $Ls_1$ at the upper portion of depth $D_T$ and a diameter $Ls_2$ larger than $Ls_1$ at the lower portion. The diameter LA of each ion beam aperture of the acceleration grid 22 is smaller than the diameter $L_D$ of the deceleration grid 23. With this configuration of aperture, a well-collimated low-divergence ion beam can be obtained. Each ion beam aperture of the screen grid 21, as illustrated in FIG. 4, has a first and second straightly bored holes with different diameters joined by a tapered hole, wherein the larger diameter hole is on the side facing the accelerator grid 22.

Extraction grids 21, 22 and 23 are usually put together before mounting onto the plasma chamber. This way, it is easier to check electrode or grid alignment and spacings. The grids 21, 22 and 23 may be trimmed at the edge to allow for thicker spacers 29A and 29B (FIG. 2). Trimming reduces the incidence of shorting and arcing. Instead of edge trimming, recessed areas can also be provided around the grid alignment holes. The inner surfaces of ring 42 and ring 43 may further be tapered (<0.5°) to concentrically warp (dish-shaped) the grids, especially the screen grid 21 and decelerator grid 23 grids. The inner surface of rings 42 or 43 form a portion of a very shallow cone. When the outer region of a grid is pressed against such surface, it assumes a concentric warp, that is, the grid is dished. Grid dishing improves structural stability. The extraction electrode assembly 20 is finally mounted onto the plasma discharge chamber sidewall 1A by bolts through the first ring 42.

Figure 5:
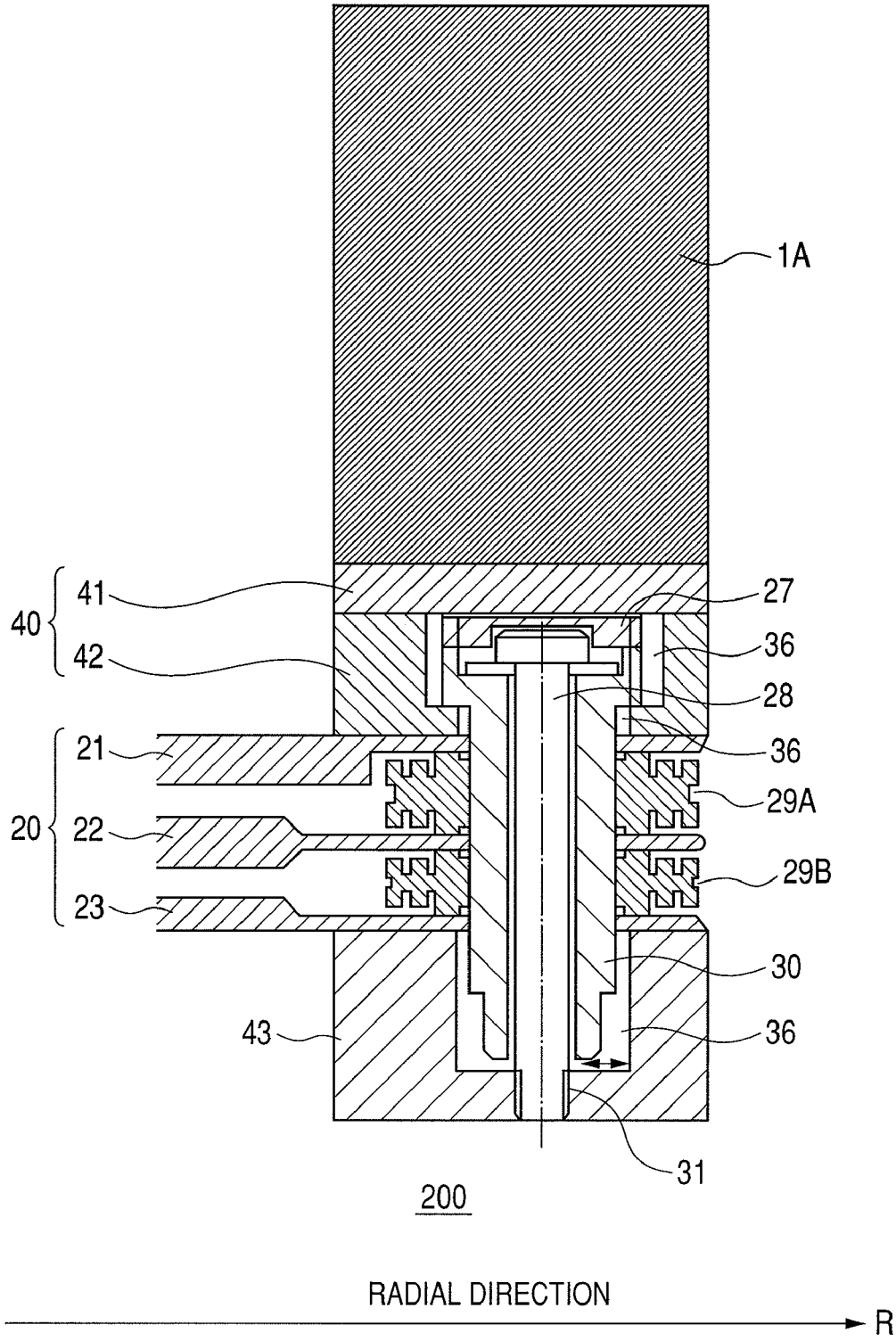
FIG. 5 is a cross sectional view of a second embodiment of ion beam generator according to the present invention.

FIG. 5 illustrates a second embodiment of grid assembly 20 in an ion beam generation 200 according to the present invention. The ion beam generator 200 of FIG. 5 has fundamentally the same configuration as that of FIG. 2. The same member are assigned with the same references numerals and a detailed description is omitted.

As a different feature from the configuration of FIG. 2, the inner diameter of the cylindrical alignment insulator 30 is enlarged and the apertures 36, in the mounting rings 42 and 43 are expanded. Due to the slightly larger thermal expansion of the mounting rings 42, 43 compared to the grids, the bolt 28 is shifted (radially outward) from the cylindrical spacer center. The enlarge apertures frees the cylindrical mounting ring to expand without unduly stretching the grids.

To further accommodate for different thermal expansions, elongated apertures 36 which are elongated in a radical direction R may be disposed in the first and second rings 42 and 43. The apertures 36 are elongated along the radial direction so that when the whole extraction electrode assembly warms up due to heat from the grids, the grid configuration (dishing etc.) is not significantly distorted. Thus, stable etching rate and uniformity are achieved in a short time.

Next, an operation of the substrate processing apparatus 100 according to the present invention will be described with reference to FIG. 1 and FIG. 2. The pressure of the plasma discharge chamber 1 is ordinarily maintained in the range of approximately $10^{-4}$ Pa ($10^{-5}$ millibars) to approximately $10^{-2}$ Pa ($10^{-3}$ millibars). A processing gas such as inert gas (Ar, Xe or Kr) is supplied into the plasma discharge chamber 1 by gas introduction means (not illustrated). For example, Ar is supplied into the plasma discharge chamber 1 by the gas introduction means, and RF power is applied to RF coil means (not illustrated), thereby generating a plasma. Ions in the plasma confined in the discharge chamber 1 are extracted by the ion extraction electrode assembly 20 to perform etching on the substrate 10.

In the illustrated embodiment, the potential $V_S$ of screen grid 21 is set to a plus potential such as 100V to 1000V, the potential $V_A$ of accelerator grid 22 is set to a minus potential between the range −1000V to −3000V, and the potential of decelerator grid 23 is set to ground. As one preferable example, $V_S<300V$ and $V_A<-1500V$ are selected where the thickness of screen grid 21 and acceleration grid 22 are 3 mm, the thickness of decelerator grid is 2 mm to 3 mm and the grid spacing is 2 mm so that the resulting beam divergence θ is less than 5°.

Figure 6:
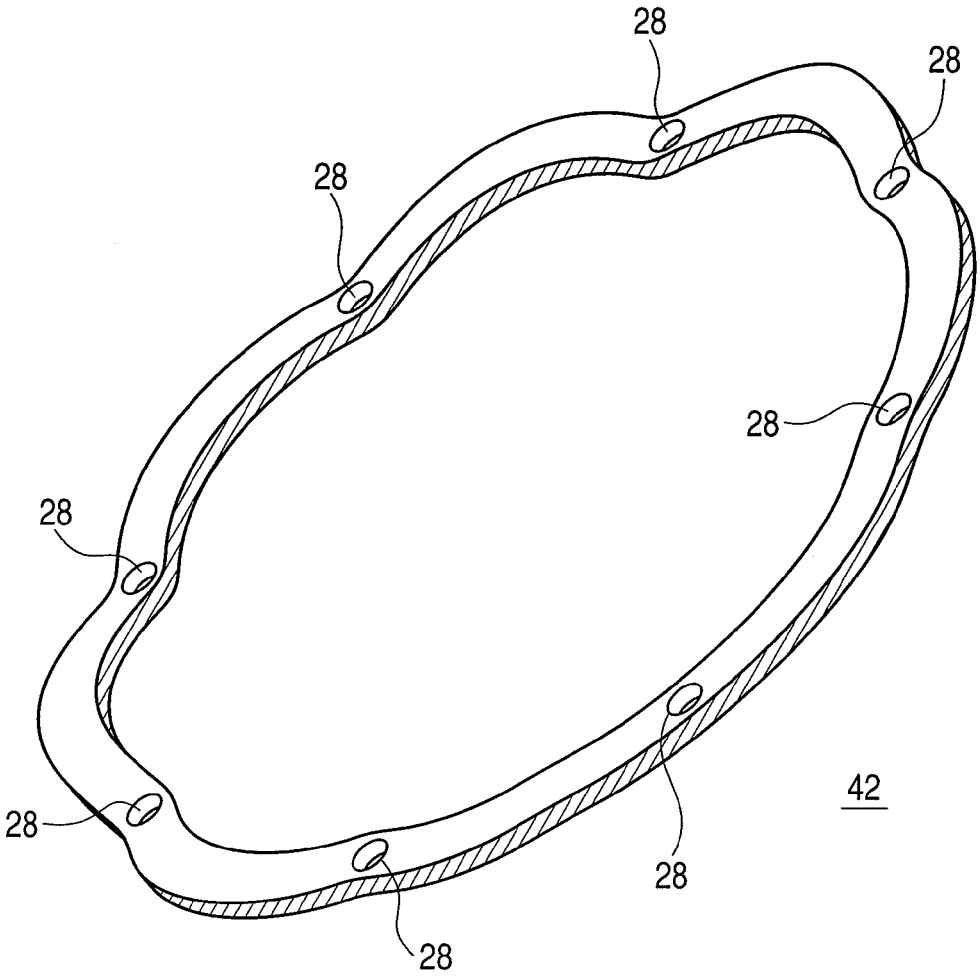
FIG. 6 illustrate a thermally expanded first ring in the first embodiment of ion beam generator of FIG. 2.
Figure 7:
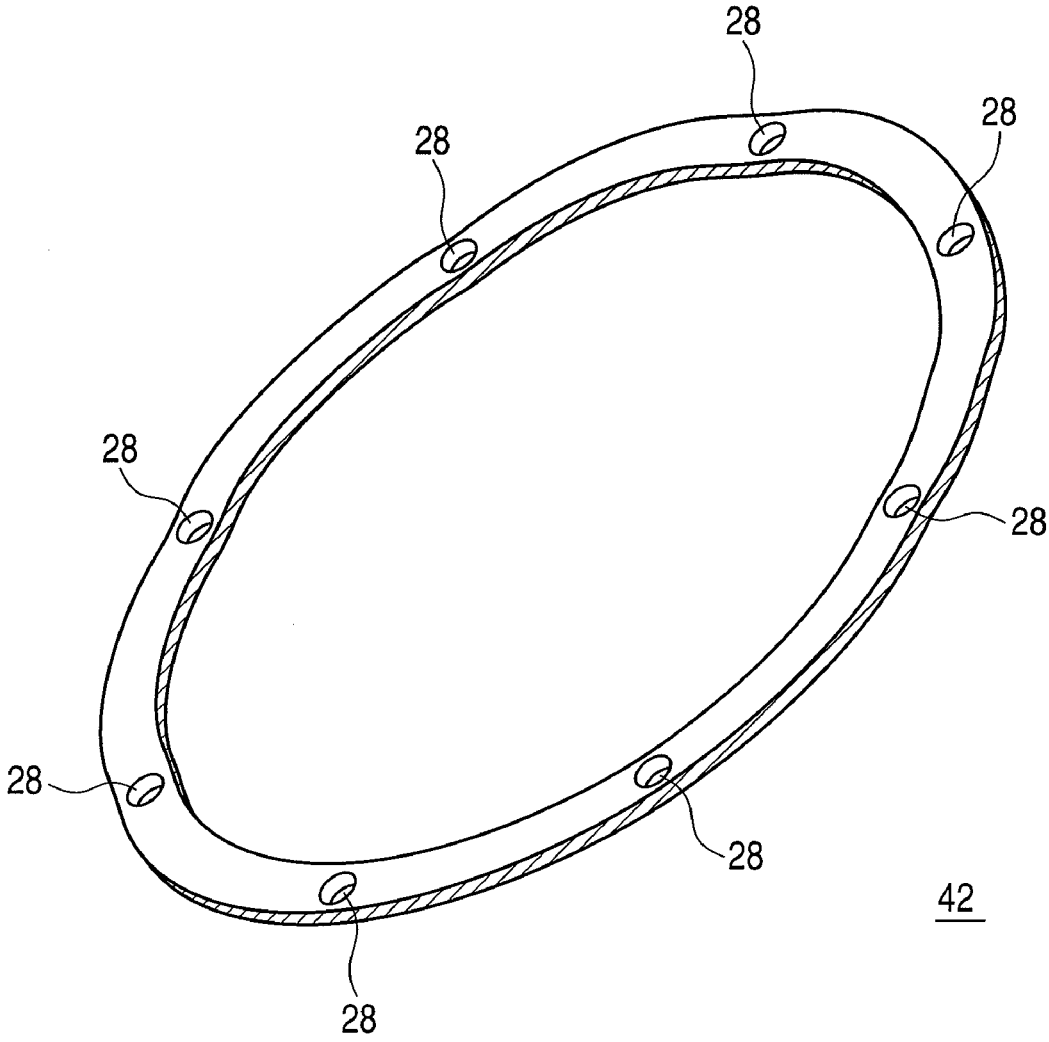
FIG. 7 illustrates a thermally expanded first ring in the second embodiment of the ion beam generator of FIG. 5.

FIG. 6 shows the effect of thermal expansion on a first mounting ring 42 with 8 apertures 50 through which bolts 28 surrounded by the cylindrical insulator 30 are inserted. The apertures may correspond to apertures needed for fixing the grids to the mounting platform 40 (see FIG. 2). The first mounting ring 42 is held rigidly at the apertures by the bolts 28 and mounted on a flat surface (parallel to ring and grids). Simulations reveal that the unbolted regions (regions except for positions fixed by the bolts) expand along the (planar) radial direction as well as rise (out-of-plane) in the direction toward the screen grid 21. The latter movement deforms the screen grid 21 that results in local changes in etching rate and therefore poor uniformity. Similar amounts of thermal expansion of the plasma chamber sidewall 1A, the first mounting ring 42, and the grids 21, 22 and 23 reduce the above effects. As a temperature gradient exists from the grids to the plasma chamber ($T_P<T_M<T_G$), the relation ($\alpha_P>\alpha_M\geqq\alpha_G$) is preferred. FIG. 7 shows the effect of thermal expansion on the first mounting ring 22 that allows relative motion between the plasma chamber sidewall 1A and the first mounting ring 22. This is achieved by providing apertures 36 elongated along the radial direction. The first ring 42 still expands in the radial direction but the out-of-plane component is minimized. A similar low-distortion effect is expected for the configuration shown in FIG. 5 where the mounting rings 42 and 43 can expand more than low thermal expansion coefficient Mo grids.

Figure 8:
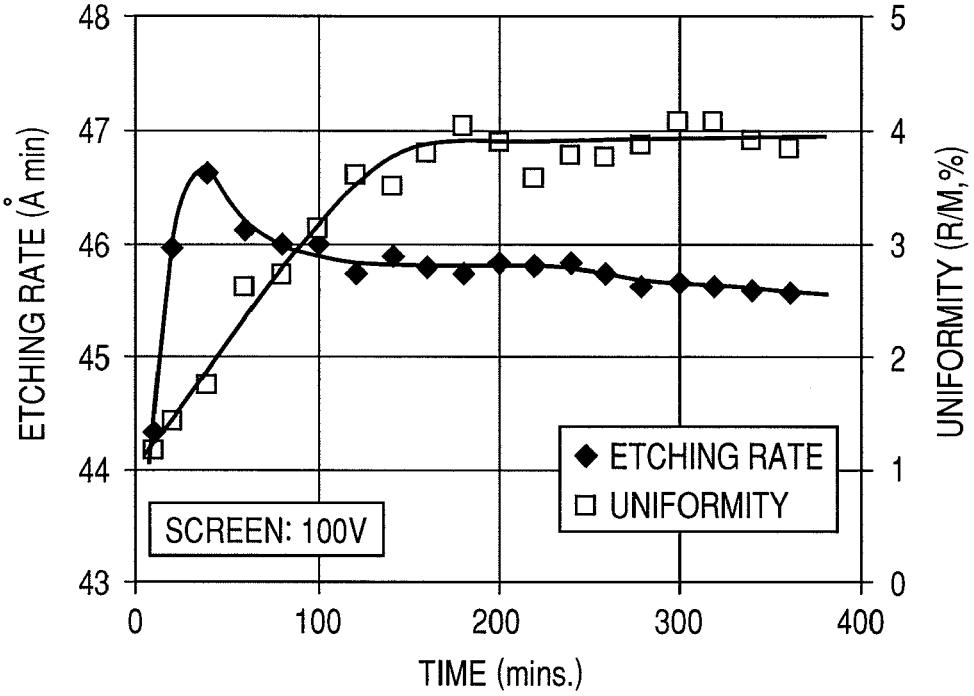
FIG. 8 shows the etching rate and uniformity dependence with time for a mounting platform made of stainless steel in the ion beam generator.

FIG. 8 shows the etching rate and uniformity dependencies with time for a mounting ring platform 40 that does not satisfy the relation ($\alpha_P>\alpha_M\geqq\alpha_G$). Here, the mounting ring is made of stainless steel. Several wafers were cycled through the module and etched with the same recipe. This is usually performed to determine the "wafer-to-wafer" (WtW) performance stability of a tool. For this case, the tool was from a cold start, that is, no preconditioning was made to warm up the tool. WtW from a cold start provides a measure on how much preconditioning is necessary before production wafers could be processed. For SUS mounting ring, the etching rate and uniformity take more than 100 minutes to stabilize. The long wait or preconditioning time to obtain a stable rate or uniformity reduces overall tool utilization. There will also be times when the tool is down due reasons other than maintenance but a long preconditioning procedure will further reduce total tool up-time and increase cost of operation.

Figure 9:
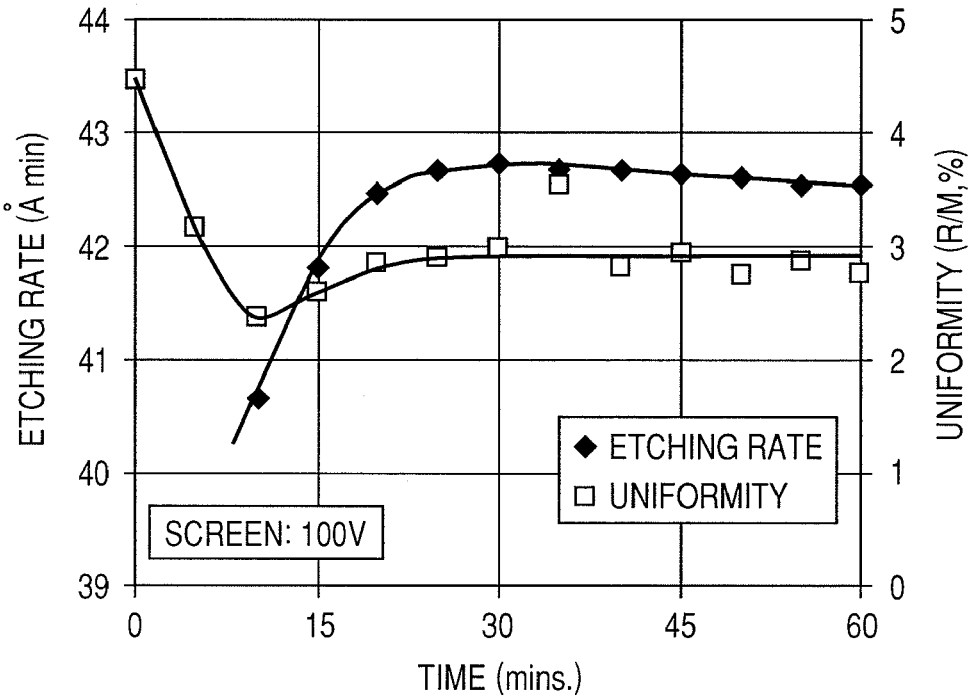
FIG. 9 shows the improvement in rate and uniformity dependency with time for a mounting platform made of titanium in the ion beam generator.

FIG. 9 shows the improvement in rate and uniformity dependency with time for a mounting platform 40 made of titanium according to the present invention ($\alpha_P>\alpha_M\geqq\alpha_G$ is satisfied). From a cold start, it takes about 15 to 20 minutes to achieve a stable rate and uniformity. A short preconditioning duration increases total tool up-time and reduces overall cost of operation for a given number of wafers. By employing titanium for the mounting platform and providing a means of releasing thermal strain, the grid assembly achieves a stable configuration faster than when using traditional stainless steel platforms. Titanium has about half the expansion coefficient of stainless steel and provides a better match to the small thermal coefficient of common grid or electrode materials such as Mo and C.

Figure 10:
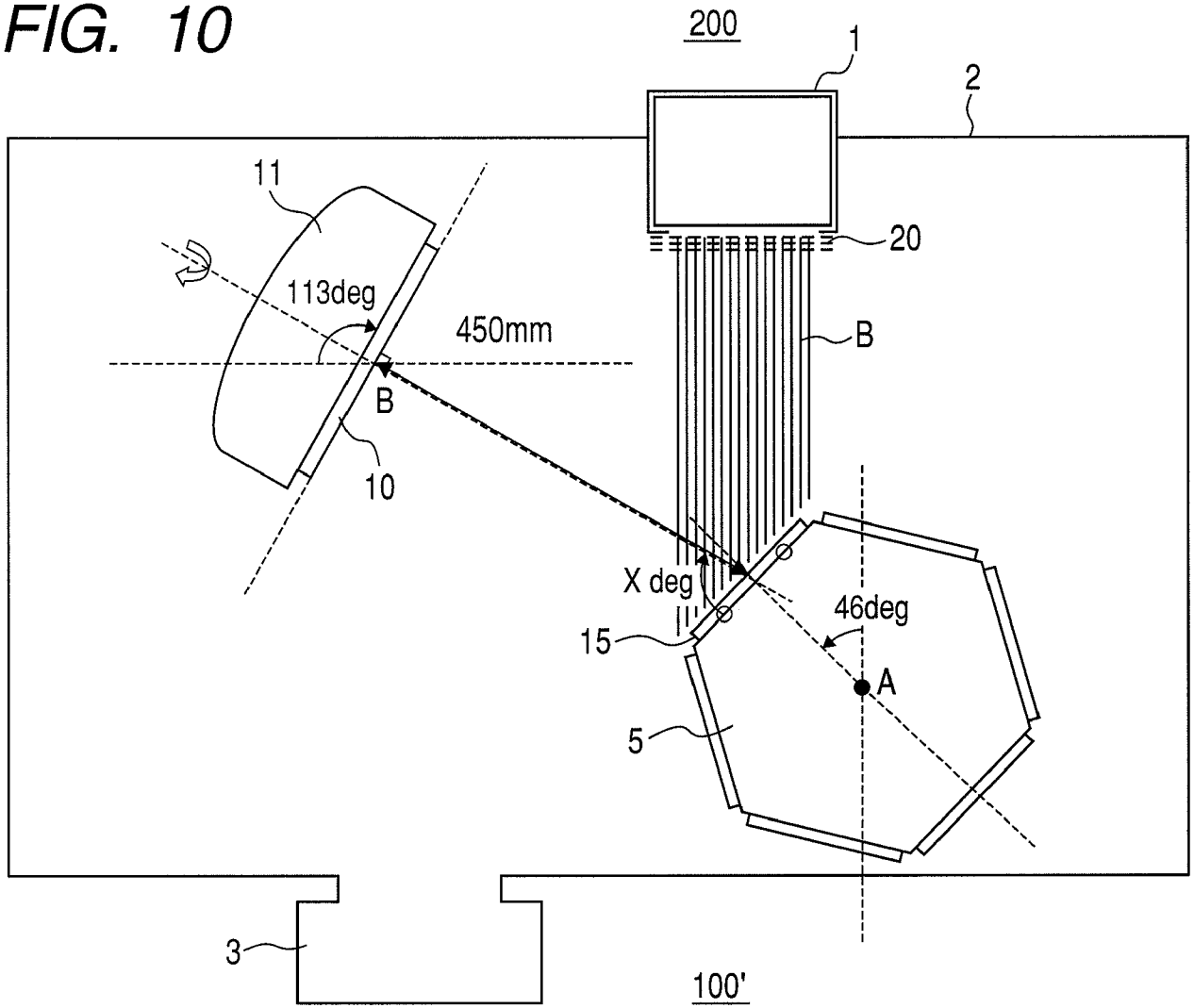
FIG. 10 is a schematic view of film deposit sputtering apparatus which includes the ion beam generator according to the present invention.

FIG. 10 shows another embodiment wherein the ion beam generator 200 is mounted in sputtering apparatus 100' for forming a film on a substrate 10. In this embodiment, the same ion beam generator is used as that in FIG. 2. Accordingly, the detailed explanation of ion beam generator 200 is omitted. The ion beam generator 200 is arranged to emit the ion beam obliquely incident onto target 15 mounted on cathode 5, such as Xdeg<90°. Target mount 5 has six mounting facets for holding up to 6 targets. It is rotatable about axis A, which is perpendicular to the plane face, like a carousel, such that one selected target is disposed to be irradiated by the ion beam. Substrate holder 11, which holds substrate 10, is disposed at a position and angle where sputter particles from the irradiated target can be deposited uniformly. Substrate holder 11 is rotatable about axis B which is perpendicular to the held substrate surface. Said holder 11 can also be panned along an axis parallel to the substrate 10 surface and parallel to axis A. Panning controls the incidence angle of incoming particles from the target.

Reference Numerals

2 0 0 Ion Beam Generator
1 Plasma Discharge Chamber
2 Processing Chamber
2 0 Extraction Electrode Assembly
1 0 0 Etching Apparatus/Substrate Processing Apparatus
3 Vacuum Pump
1 0 Substrate (Wafer)
1 1 Substrate Holder
1 2 Rotatable Cathode
S Slit
1 A Sidewall of Discharge Chamber 1
4 0 Mounting Platform
4 1 Cap Ring
4 2 First Ring
4 3 Second Ring
2 1 Screen Grid
2 2 Accelerator Grid
2 3 Decelerator Grid
2 7 Insulating Bolt
2 8 Bolt
2 9 A and 2 9 B Spacer Insulators
3 0 Cylindrical Alignment Insulator
3 1 Taped Port
6 Central Aperture Region
7 Outer Region
8 Opening
2 8 Fixing Bolt
3 6 Space
1 0 0' Sputtering Apparatus
5 Carousel Cathode
1 5 Target

The invention claimed is:

1. An ion beam generator comprising a plasma discharge chamber;

an extraction electrode assembly, which extracts ions in the plasma generated in the plasma discharge chamber and generates an ion beam;

a mounting platform disposed between the plasma discharge chamber and the extraction electrode assembly for mounting the extraction electrode assembly into the plasma discharge chamber, wherein at least part of the sidewall of the plasma discharge chamber which contacts the mounting platform has thermal expansion coefficient TEC=$\alpha_P$, the mounting platform has thermal expansion coefficient TEC=$\alpha_M$ and the extraction electrode assembly has thermal expansion coefficient TEC=$\alpha_G$ where the $\alpha_P$, $\alpha_M$, and $\alpha_G$ satisfy the formula:

$$\alpha_P>\alpha_M\geqq\alpha_G.$$

2. The apparatus according to claim 1, wherein the extraction electrode assembly comprises a screen grid mounted on the mounting platform, an accelerator grid mounted on the screen grid by interposing an insulator therebetween, and a decelerator grid mounted on the accelerator grid by interposing an insulator therebetween.

3. The apparatus according to claim 2, wherein the material of the grids are selected from the group consisting of Mo, W, and C.

4. The apparatus according to claim 2, wherein the thickness of the grid ≧2 mm.

5. The apparatus according to claim 2, wherein the mounting platform comprises a first annular ring in contact with the screen grid.

6. The apparatus according to claim 2, wherein the screen grid has apertures through which the ion beam passes, each aperture having a first and second straightly bored holes with different diameters joined by a tapered hole, wherein the larger diameter hole is on the side facing the accelerator grid.

7. The apparatus according to claim 1, wherein the material of the sidewall of the plasma discharge chamber is selected from the group consisting of stainless steel and aluminum.

8. The apparatus according to claim 1, wherein the material of the mounting platform is selected from the group consisting of Ti and Mo.

9. An ion beam generator comprising:

a plasma discharge chamber;

a ring-like mounting platform attached to an annular sidewall of the plasma discharge chamber and comprising a first ring member and a second ring member;

a disc-like extraction electrode assembly mounted between the first and second ring members of the mounting platform; and a bolt surrounded by an insulator, wherein each of the first and the second ring members of the mounting platform and the extraction electrode assembly has the bolt apertures at the peripheral region thereof through which the bolt surrounded by the insulator penetrates and the penetrated bolts fix the extract electrode assembly between the first and second ring members, and wherein the inner surfaces of the bolt apertures in the extraction electrode assembly tightly contact with the outer surface of the insulator surrounding the bolt and the bolt aperture in the first and second ring members are elongated in a radical direction so that there is a spacing between the inner surfaces of the bolt apertures in the first and second ring members and the outer surface of the insulator surrounding the bolt.

10. The ion beam generator according to claim 9, wherein the sidewall of the plasma discharge chamber has thermal expansion coefficient TEC=$\alpha_P$, the mounting platform has thermal expansion coefficient TEC=$\alpha_M$ and the extraction electrode assembly has thermal expansion coefficient TEC=$\alpha_G$ where the $\alpha_P$, $\alpha_M$, and $\alpha_G$ satisfy the formula: $\alpha_P > \alpha_M \geqq \alpha_G$.

* * * * *